United States Patent [19]

Sorrells, Jr.

[11] 4,156,993

[45] Jun. 5, 1979

[54] REGLET AND COUNTERFLASHING

[75] Inventor: Paul J. Sorrells, Jr., Tucker, Ga.

[73] Assignee: MM Systems Corporation, Tucker, Ga.

[21] Appl. No.: 893,419

[22] Filed: Apr. 4, 1978

[51] Int. Cl.[2] ..... E04D 1/36; E04D 3/38; E04D 13/14

[52] U.S. Cl. ..... 52/60; 52/61

[58] Field of Search ..... 52/60, 61

[56] References Cited

U.S. PATENT DOCUMENTS

| | | | |
|---|---|---|---|
| 1,905,017 | 4/1933 | Vallas | 52/61 |
| 2,168,204 | 8/1939 | Hanson | 52/60 |
| 2,219,992 | 10/1940 | Hanson | 52/60 |
| 2,974,448 | 3/1961 | Weis | 52/60 |

FOREIGN PATENT DOCUMENTS

| | | | |
|---|---|---|---|
| 7708902 | 8/1977 | Netherlands | 52/61 |
| 1399505 | 7/1975 | United Kingdom | 52/60 |

*Primary Examiner*—Alfred C. Perham
*Attorney, Agent, or Firm*—John B. Armentrout

[57] ABSTRACT

Reglet means, counterflashing, and connector and biasing means are provided having the reglet means adapted to be secured to a building wall to afford flashing above a roofing end reaching upwardly and lapping the wall. The reglet means includes hood structure which receives shaped upper end means of the counterflashing while apron means of the hood structure, and the connector and biasing means, are interrelated so that with the connector and biasing means being inserted into the hood structure from below, with bight means of the connector and biasing means leading, first presser means of the connector and biasing means and means on the apron means engage for stopping the connector and biasing means against being retracted from the hood structure, and second presser means of the connector and biasing means acts against the counterflashing for the latter to cover and urge the roofing end to be supported against the building wall while the connector and biasing means arrests the shaped upper end means of the counterflashing against downward movement from the hood structure.

11 Claims, 4 Drawing Figures

REGLET AND COUNTERFLASHING

Figure 2:
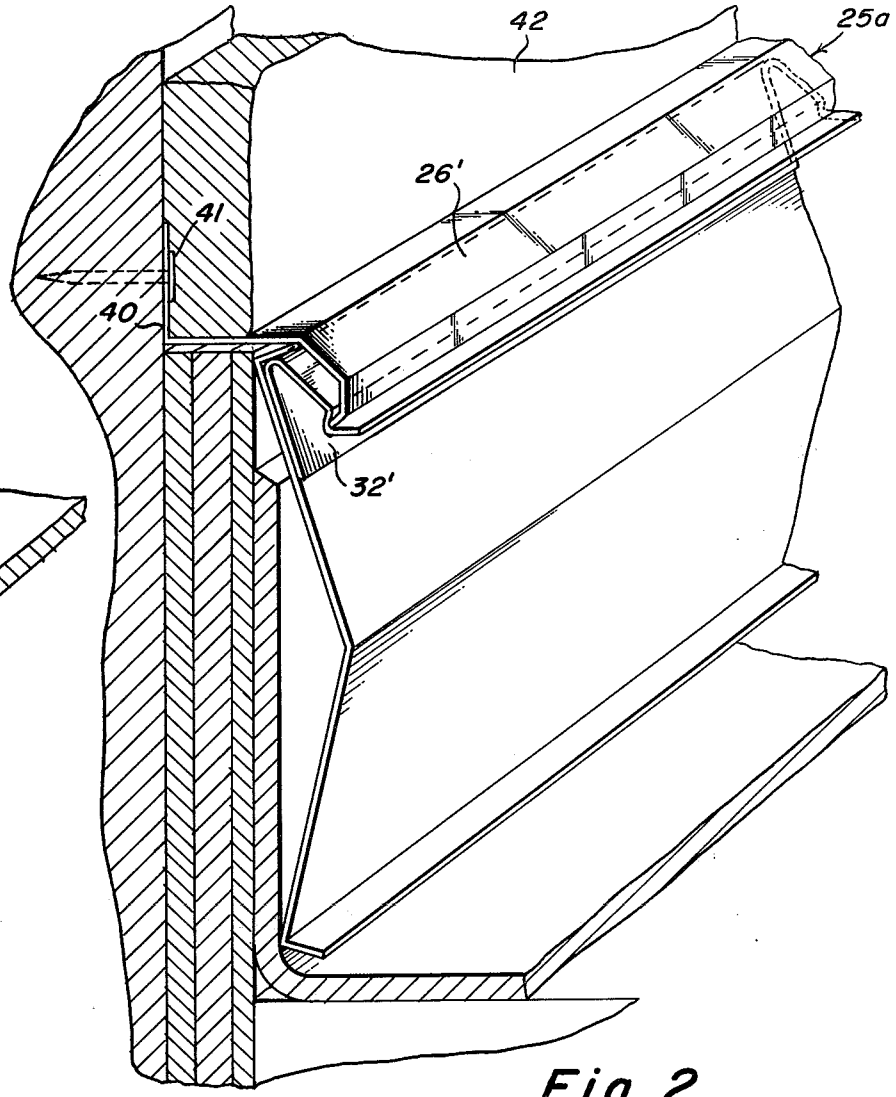

This invention relates to covers for roof and wall junctions in a building, and is more particularly concerned with covers which introduce flashing including reglet means and counterflashing in the structure thereof.

An object of the present invention is the provision of a practical and commerically feasible cover for a roofing end, to enclose and protect the roofing end and adjacent upper portions of a building wall from rain or other ambient conditions encountered while the roofing end laps upwardly outside the building wall.

Another object herein is to provide a reliable and easy to install cover for a roofing end lapped upwardly outside a building wall, which cover is characterized by having reglet means and counterflashing, and also by having connector and biasing means serving to interlock with hood structure of the reglet means in response to being inserted, with a bight portion thereof leading, into the hood structure, thereafter to have presser means of the connector and biasing means pressing against the counterflashing for the connector and biasing means to maintain the counterflashing assembled extending downwardly outside the hood structure and roofing end and urge the counterflashing to press the roofing end to be supported against the building wall.

Other objects of the present invention will in part be obvious and in part pointed out more fully hereinafter.

As conducive to a clearer understanding of certain features of the present invention, it is noted that in building structures a roofing end may form a junction with a wall or walls of the building, in which event it is conventional practice that the wall be covered upwardly for a distance from the roof itself by an upward extension of the roofing, having the extension or roofing end lap the face of the building wall. Rain and other elements such as wind or snow make it important to provide flashing to conceal the roofing end against the effects of weather, and therefore flashings for that purpose have heretofore been introduced.

The present invention resides in flashings of the character which include reglet means and counterflashing. The reglet means is adapted to be secured to the building wall so as to be disposed some short distance above the roofing end which laps upwardly outside the wall. The counterflashing is used to lead downwardly from inside a hood structure of the reglet means and project to cover the upwardly directed end of the roofing lap so as to place the lap between the counterflashing and the building wall. Numerous means heretofore have been provided for connecting counterflashing with reglet means, and the present invention lends improvements in roofing lap cover structure wherein counterflashing is connected with reglet means.

In accordance with the present invention, a first flashing means is provided which includes lower longitudinal lateral wall means to extend longitudinally laterally outside and cover an upwardly directed roofing lap adjacent to the face of a building wall, and the first flashing means further is characterized by having upper longitudinal lateral wall means for the upper longitudinal lateral wall means to extend longitudinally laterally outside and cover the face of the building wall above the roofing lap. The latter expression also is intended to include the circumstance that the roofing lap in certain installations may extend further upwardly also to be between the upper longitudinal lateral wall means of the first flashing means and the building wall along with being between the lower longitudinal lateral wall means of the first flashing means and the building wall. The upper longitudinal lateral wall means of the first flashing means further is characterized by having laterally projecting means to be engaged in a manner which is hereinafter to be set forth.

Second flashing means, also provided in the roofing end cover, is adapted to be connected with the building wall and comprises reglet means having hood wall means for the latter to extend longitudinally and laterally above the roofing lap and the first flashing means. The hood wall means includes apron means which laterally downwardly projects outside the longitudinal laterally projecting means of the upper longitudinal lateral wall means of the first flashing means and outside the building wall, the apron means having means to be engaged as will be explained further through remarks to follow.

Resilient connector and biasing means, also in the roofing lap cover structure, comprises first and second presser means and bight means interconnecting the first and second presser means, the first presser means having means for engaging the engagable means of the apron means in response to insertion of the connector and biasing means into space inside the hood wall means with the bight means leading. After engagement of the first presser means with the engagable means of the hood wall means, the second presser means presses the upper lateral wall means of the first flashing means to be supported against the building wall while the lower longitudinal lateral wall means of the first flashing means presses the roofing lap to be supported against the building wall, and the bight means restrains the longitudinal laterally projecting means of the first flashing means against downward movement from the space inside the hood wall means.

Figure 1:
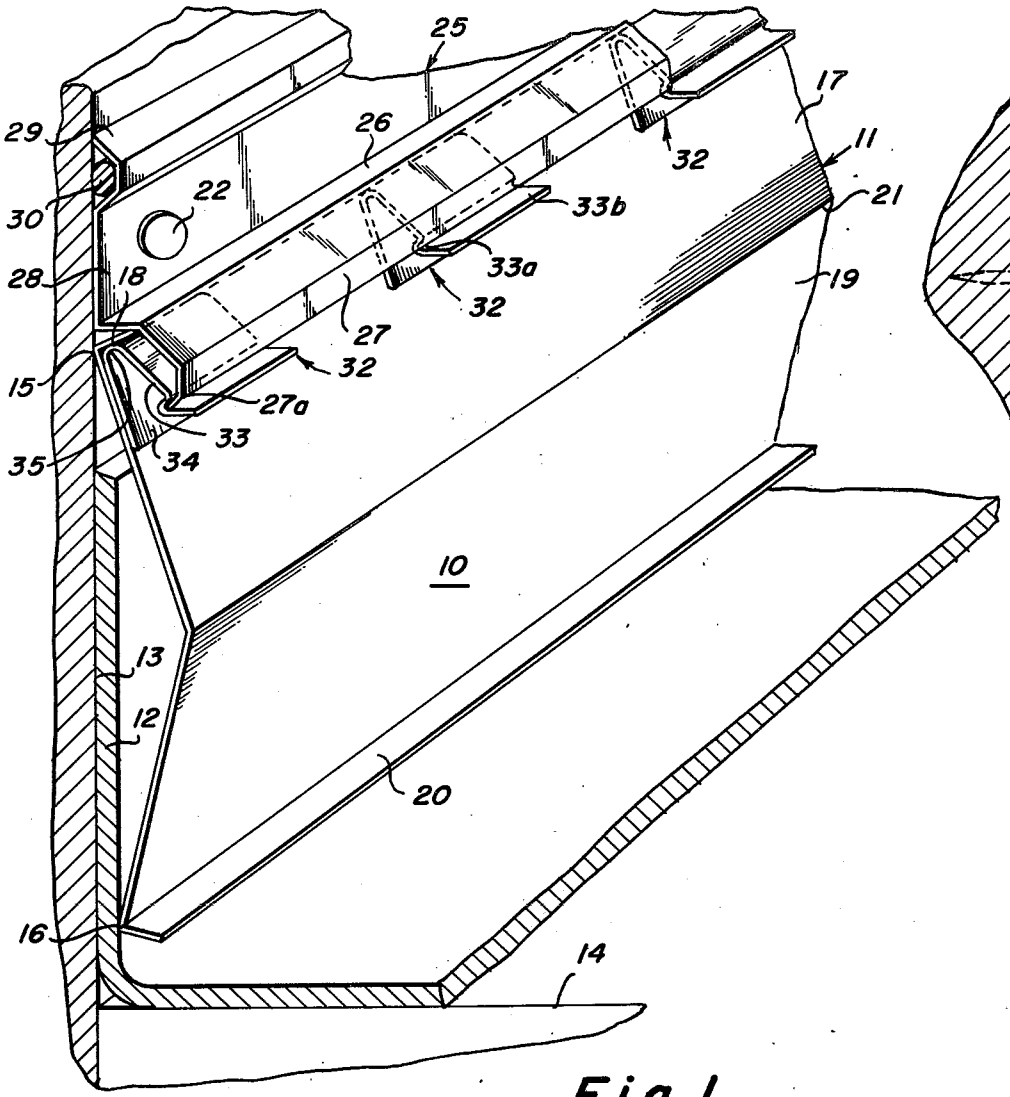
Figure 3:
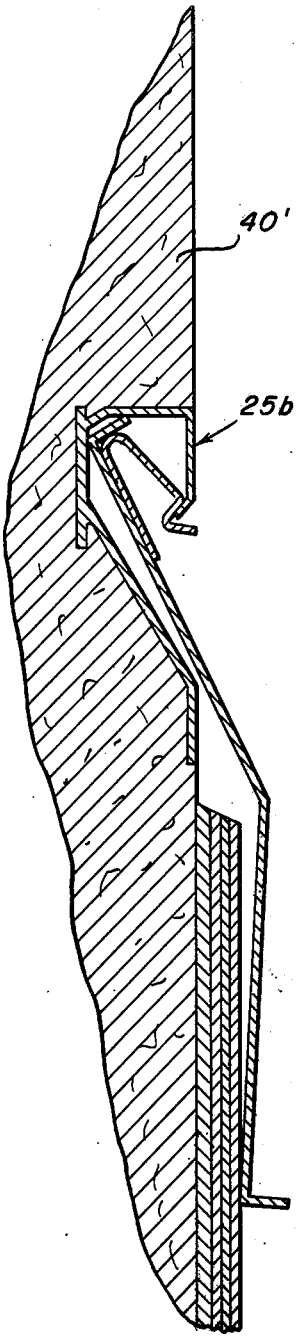
Figure 4:
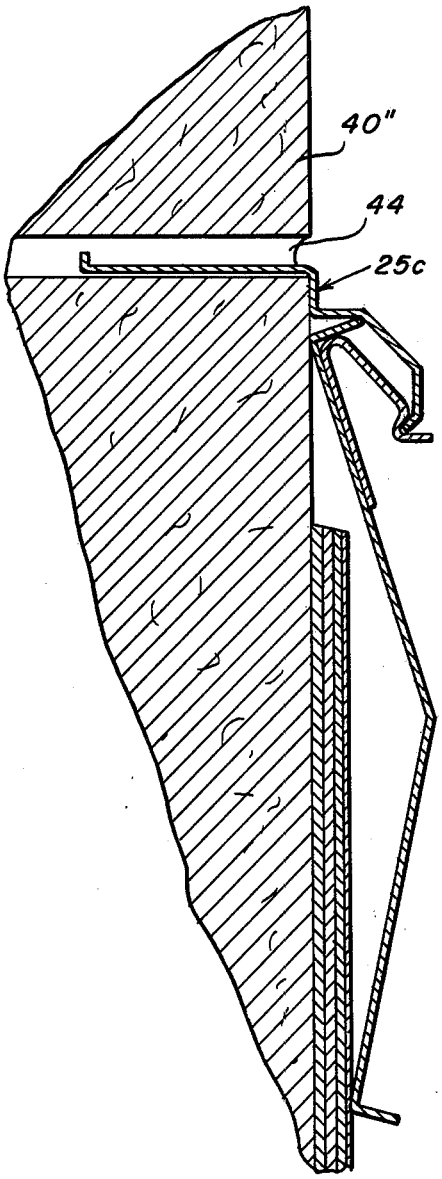

In the accompanying drawing wherein several embodiments of this invention are represented:

FIG. 1 is an isometric view of a roofing lap joint cover installed and associated with roofing and a wall of a building;

FIG. 2 is an isometric view comparable with FIG.1 and represents a modification of the connector and biasing means used between the upper and lower flashings and further represents a modified form of connection of the upper flashing with a modified kind of building wall; and FIGS. 3 and 4 are respectively transverse cross sections comparable with either of FIGS. 1 and 2, and representing each a further modification of the upper flashing and the connection thereof with an appropriate building wall.

In the embodiment represented in FIG. 1, a roofing lap cover, designated in general by the reference numeral 10, is installed having counterflashing 11 thereof extend over a roofing end lap 12, which is upwardly directed along a face 13 of a building wall and is bent as an extension of sheet material, such as of a bitumen or other suitable type, on the building roof 14. The counterflashing 11 is strip-like in structure, longitudinally having upper and lower parallel lateral contact means 15 and 16, and the counterflashing is made for example of aluminum alloy, galvanized steel or of plastic. Upper longitudinal lateral wall means 17 and upper longitudinal laterally projecting flange means 18 intersect to form the upper contact means 15 in the counterflashing 11, and lower longitudinal lateral wall means 19 and lower longitudinal laterally projecting flange means 20 in the counterflashing 11 intersect to form the lower contact means 16. Longitudinally intermediately of the upper and lower contact means 15 and 16 the counterflashing is laterally offset from the upper and lower contact means, this offset in the present embodiment being achieved through having the upper longitudinal lateral wall means 17 and the lower longitudinal lateral wall means 19 inclined outwardly relatively to each other from the upper and lower contact means 15 and 16 and intersecting at an arris 21 which is longitudinally parallel with the contact means 15 and 16 on the length of the counterflashing 11.

Referring further to the embodiment represented in FIG. 1, the roofing end lap joint cover 10 also includes second flashing means 25, and this second flashing means is installed on the building wall against the wall face 13, such as by use of nails 22, to lead longitudinally generally parallel with the roof 14 somewhat above the roofing end lap 12. Reglet means of the second flashing means 25 comprises hood wall means 26 which leads longitudinally of the second flashing means and comprises apron means 27 laterally projecting downwardly outside the upper lateral end of the counterflashing 11 which is inserted upwardly into upwardly entrant space defined by the hood wall means 26 with the building wall face 13. The apron means 27 is provided with downwardly and inwardly directed longitudinal tongue means **27*a* for this tongue means to be engaged in a manner to be described more fully hereinafter. Upwardly from the hood wall means 26 the second flashing means 25 is inclusive of longitudinal laterally narrow panel means 28 through which the aforementioned nails 22 are introduced for securing the second flashing means to the face 13 of the building wall. Upper longitudinal groove-forming means 29 joined with the narrow panel means 28 and situated immediately above the latter is shaped to receive sealant, such as a sealing strip 30 extending throughout the length of the second flashing means, and to press this sealant against the building wall face 13 when the second flashing means has been installed. The body of the second flashing means 25** illustratively is fashioned from aluminum alloy, galvanized steel, plastic, or from any other suitable material.

For assembling the counterflashing or first flashing means 11 with the second flashing means 25, the roofing end lap joint cover 10 further is characterized by having resilient connector and biasing means 32 wherein first and second presser means 33 and 34 are interconnected by bight means 35. Grooveforming means **33*a* and lip means 33*b* of the first presser means 33 are arranged for the groove-forming means to spring into engagement with the apron tongue means 27*a* in response to upward insertion of the connector and biasing means 32 into the space under the hood wall means 26 and have lip means 33*b* of the first presser means 33 laterally project outside the apron means to an accessible position for the connector and biasing means 32 later to be controlled for release, if desired, working from the exterior of the hood wall means. The lip means 33*b* of the first presser means 33, and the inwardly directed tongue 27*a* of the apron means 27 beneficially define a groove for guiding the end of a hand tool (not shown) which may be used to apply pressure for releasing the connector and biasing means 32 from the installed condition. With the groove-forming means 33*b* engaging the apron tongue means 27*a* as described, and with the upper flange means 15 of the counterflashing 11 inserted previously to be inside the space under the hood wall means 26, the bight means 35 of the connector and biasing means 32 supports the upper flange means 15 against having the counterflashing 11 move downwardly, and meanwhile the second presser means 34 is pressing against the upper longitudinal lateral wall means 17 of the counterflashing to press the upper contact means 15 of the counterflashing to be supported against the face 13 of the building wall while the second presser means 34 also presses the lower contact means 16 against the roofing lap 11 with the latter being supported against the face 13 of the building wall, whereby the roofing lap 11 is closed off from the weather by the counterflashing 11 while having this counterflashing covered at upper lateral end by the second flashing means 25**.

The reach of the first presser means 33 is adequate for the bight means 35 to support the upper flange means 15 into contact with the inner face of the hood wall means 26 when the apron tongue means **27*a* and the groove-forming means 33*b* of the first presser means 33 are engaged, thereby stabilizing the counterflashing against both upward and downward movement; however, in certain embodiments, still in accordance with the present invention, the reach of the first presser means 33 may instead be made less than that just mentioned, for the connector and biasing means 32, as installed, to arrest downward movement of the counterflashing while tolerating upward lateral movement, to some extent, toward the inner face of the hood wall means 26 should this upward movement be forced. It will also be understood that while the first presser means 33 has been described as having groove-forming means 33*b* and the apron means 27 has been described as having tongue means 27*a*, these means may in certain embodiments, still in accordance with the present invention, be reversed to have groove-forming means afforded by the apron means and tongue means afforded by the first presser means, thus for the connector and biasing means to be engaged with the hood wall means and thereafter act in a manner similar to that hereinbefore described. Where an installation of the cover 10 requires more than one section of the counterflashing 11, or of the second flashing means 25**, the sections may of course be suitably spliced or be adapted to be lapped lengthwise to extend the installation.

In the embodiment of FIG. 1, the connector and biasing means 32 of the character hereinbefore described is comprised of a plurality of generally U-shaped members each characterized by including first and second presser means 33 and 34 and interconnecting bight means 35, with the U-shaped members, as installed, being spaced apart from one another longitudinally of the apron means 27. The spaced U-shaped members, just described, contribute to ease of installation of the cover 10 and offer savings in material. In certain practices, in accordance with the present invention, and as sometimes preferred, the connector and biasing means is instead provided as a single member, or as members which substantially abut one another end to end longitudinally of the apron means 27, thus to have substantially the same longitudinal reach or continuity as the apron means and thereby conceal the upper lateral end of the counterflashing 11 inside the hood wall means 26 from outside view.

In the embodiments represented in FIGS. 2, 3 and 4, somewhat modified second flashing means is introduced, and otherwise the details of the foregoing disclosure are applicable to the latter three embodiments. The second flashing means 25a in FIG. 2 is adapted to extend behind a stucco or other type building wall veneer 42 and this includes a nailing extension 40 for being secured to a substrate of the wall by nails 41 before the veneer 42 is applied to the substrate. It will also be noted that connector and biasing means 32' provided, similar in transverse cross section to the generally U-shaped clips hereinbefore described with reference to FIG. 1, coextends longitudinally substantially continuously with the hood wall means 26', for maintaining the counterflashing installed, though, if desired, generally U-shaped clips spaced apart from one another longitudinally of the hood wall means, and of the character described with reference to FIG. 1, may instead be used.

In the embodiment represented in FIG. 3, the second flashing means 25b is in the form of an extension embedded in a masonry wall 40' to afford hood and apron wall means enclosing the upper lateral end of the counterflashing and to receive the connector and biasing means.

In the FIG. 4 embodiment, the structure for anchoring the second flashing means 25c to a block or brick masonry type building wall 40'' includes an extension which is embedded in a mortar joint 44 in the wall.

As the invention lends itself to many possible embodiments, and as many possible changes may be made in the embodiments hereinbefore set forth, it will be distinctly understood that all matter described herein is to be interpreted as illustrative and not as a limitation.

I claim:

1. In structure for covering a joint produced from roofing lapped upwardly outside a building wall, the combination which includes first flashing means having lower longitudinal lateral wall means for said lower lateral longitudinal wall means to extend longitudinally laterally outside said roofing lap, and said first flashing means having upper longitudinal lateral wall means for said upper longitudinal lateral wall means to extend longitudinally laterally outside said building wall, said upper longitudinal lateral wall means of said first flashing means having longitudinal laterally projecting means to be engaged; second flashing means for being connected with said building wall and comprising reglet means having hood wall means to extend longitudinally and laterally above said roofing lap and said first flashing means, said hood wall means including apron means for laterally downwardly projecting outside said longitudinal laterally projecting means of said upper lateral longitudinal wall means of said first flashing means and outside said building wall, and said apron means having means to be engaged; and resilient connector and biasing means including at least one unitary member comprising spaced first and second presser means and bight means interconnecting said first and second presser means, said first presser means having means for engaging said engagable means of said apron means, and either said engagable means of said apron means and said engagable means of said first presser means including tongue means and the other of said engagable means of said apron means and said first presser means including groove-forming means, for said connector and biasing means inserted into space inside said hood wall means with said bight means leading and having said tongue means and said groove-forming means of said first presser means and said apron means engaged to have said second presser means pressing said upper longitudinal lateral wall means of said first flashing means to be supported against said building wall while said lower longitudinal lateral wall means of said first flashing means presses said roofing lap to be supported against said building wall and said bight means restrains said longitudinal laterally projecting means of said first flashing means against downward movement from said space inside said hood wall means by having said apron means arrest rectilinear lateral movement of said first flashing means, at least in a normally downward direction, with said tongue means and said groove-forming means of said first presser means and said apron means being engaged.

2. In structure for covering a joint produced from roofing lapped upwardly outside a building wall as set forth in claim 1 wherein said hood wall means and said resilient connector and biasing means have substantially equal longitudinal reach.

3. In structure for covering a joint produced from roofing lapped upwardly outside a building wall as set forth in claim 1 wherein said resilient connector and biasing means includes a plurality of units spaced apart from one another longitudinally of said hood wall means and said units comprise said first and second presser means interconnected by said bight means.

4. In structure for covering a joint produced from roofing lapped upwardly outside a building wall as set forth in claim 1 wherein said first flashing means includes upper and lower contact means for supporting said first flashing means, and said first flashing means further includes wall structure supported offset from said building wall by said first and second contact means and pressed toward said building wall by said second presser means of said resilient connector and biasing means when said engagable means of said first presser means of said resilient connector and biasing means and said engagable means of said apron means are engaged.

5. In structure for covering a joint produced from roofing lapped upwardly outside a building wall as set forth in claim 1 wherein said bight means of said resilient connector and biasing means maintains said first flashing means against said hood wall means while said engagable means of said first presser means of said resilient connector and biasing means and said engagable means of said apron means are engaged and said second presser means of said resilient connector and biasing means presses said upper longitudinal lateral wall means of said first flashing means to be supported against said building wall.

6. In structure for covering a joint produced from roofing lapped upwardly outside a building wall, the combination which includes first flashing means having lower longitudinal lateral wall means for said lower longitudinal lateral wall means to extend longitudinally laterally outside said roofing lap, and said first flashing means having upper longitudinal lateral wall means for said upper longitudinal lateral wall means to extend longitudinally laterally outside said building wall, said upper longitudinal lateral wall means of said first flashing means having longitudinal laterally projecting means to be engaged; second flashing means for being connected with said building wall and comprising reglet means having hood wall means to extend longitudinally and laterally above said roofing lap and said first flashing means, and said hood wall means including apron means for laterally downwardly projecting outside said longitudinal laterally projecting means of the upper longitudinal lateral wall means of said first flashing means and outside said building wall, and said apron means having means to be engaged; and resilient connector and biasing means comprising first and second presser means and bight means interconnecting said first and second presser means, said first presser means having means for engaging said engagable means of said apron means, for said connector and biasing means inserted into space inside said hood wall means with said bight means leading and having said engagable means of said first presser means engaging said engagable means of said apron means to have said second presser means pressing said upper longitudinal lateral wall means of said first flashing means to be supported against said building wall while said lower longitudinal lateral wall means of said first flashing means presses said roofing lap to be supported against said building wall and said bight means restrains said longitudinal laterally projecting means of said first flashing means against downward movement from said space inside said hood means, and said first presser means further including lip means accessible outside said apron means of said hood wall means for being engaged for springing said bight and connector means and disengaging said engagable means of said first presser means and said engagable means of said apron means.

7. In structure for covering a joint produced from roofing laped upwardly outside a building wall as set forth in claim 6 wherein externally of said apron means said lip means and said apron means introduce groove-forming structure to receive a tool for disengaging said engagable means of said first presser means and said engagable means of said apron means.

8. In structure for covering a joint produced from roofing lapped upwardly outside a building wall as set forth in claim 6 wherein said hood wall means and said resilient connector and biasing means have substantially equal longitudinal reach.

9. In structure for covering a joint produced from roofing lapped upwardly outside a building wall as set forth in claim 6 wherein said resilient connector and biasing means include a plurality of units spaced apart from one another longitudinally of said hood wall means and said units comprise said first and second presser means interconnected by said bight means.

10. In structure for covering a joint produced from roofing lapped upwardly outside a building wall as set forth in claim 6 wherein said resilient connector and biasing means include at least one unitary member comprising spaced first and second presser means and bight means interconnecting said first and second presser means, and either said engagable means of said first presser means and said engagable means of said apron means including tongue means and the other of said engagable means of said first presser means and said engagable means of said apron means including groove-forming means for said connector and biasing means inserted into space inside said hood wall means with said bight means leading and having said tongue means and said groove-forming means of said first presser means and said apron means engaged to have said second presser means pressing said upper longitudinal lateral wall means of said first flashing means to be supported against said building wall while said lower longitudinal lateral wall means of said first flashing means presses said roofing end to be supported against said building wall.

11. In structure for covering a joint produced from roofing lapped upwardly outside a building wall as set forth in claim 10 wherein said first flashing means includes upper and lower contact means for supporting said first flashing means, and said first flashing means further includes wall structure supported offset from said building wall by said first and second contact means and pressed toward said building wall by said second presser means of said resilient connector and biasing means when said engagable means of said first presser means of said resilient connector and biasing means and said engagable means of said apron means are engaged.

* * * * *